US005730389A

United States Patent [19]

Biagiotti

[11] Patent Number: 5,730,389

[45] Date of Patent: Mar. 24, 1998

[54] DEVICE AND METHOD FOR THE AUTOMATIC EXCHANGE OF REELS OF WEB MATERIAL

[75] Inventor: Guglielmo Biagiotti, Capannori, Italy

[73] Assignee: Fabio Perini S.p.A., Lucca, Italy

[21] Appl. No.: 737,997

[22] PCT Filed: Jun. 7, 1995

[86] PCT No.: PCT/IT95/00097

§ 371 Date: Dec. 2, 1996

§ 102(e) Date: Dec. 2, 1996

[87] PCT Pub. No.: WO95/34497

PCT Pub. Date: Dec. 21, 1995

[30] Foreign Application Priority Data

Jun. 16, 1994 [IT] Italy ..... FI94A0123

[51] Int. Cl.[6] ..... B65H 19/18

[52] U.S. Cl. ..... 242/556.1; 156/502

[58] Field of Search ..... 242/551, 552, 242/553, 555, 555.1, 555.2, 556, 556.1; 156/502, 504

[56] References Cited

U.S. PATENT DOCUMENTS

| | | | |
|---|---|---|---|
| 3,740,296 | 6/1973 | McDonald . | |
| 3,753,833 | 8/1973 | Bassett et al. | 156/504 |
| 3,858,819 | 1/1975 | Butler . | |
| 4,392,912 | 7/1983 | Horsley | 156/504 |
| 4,629,531 | 12/1986 | Kataoka | 156/504 |
| 4,708,300 | 11/1987 | Goetz | 242/551 |
| 4,908,091 | 3/1990 | Traegaardh et al. | 156/502 |
| 5,584,446 | 12/1996 | Delmore et al. | 242/555 |

FOREIGN PATENT DOCUMENTS

91/16256 10/1991 WIPO .

*Primary Examiner*—John M. Jillions
*Attorney, Agent, or Firm*—Breiner & Breiner; Francis J. Bouda

[57] ABSTRACT

A device for the automatic exchange of a first reel on which a first web is wound with a second reel on which a second web is wound includes a pair of supports for the reels which are movable in a direction parallel to the axis of the reels. A first retaining member is fixed to each of the supports for the leading end of the second web, with each of the first retaining members being movable with the corresponding support between a lateral waiting position and a position of alignment with a second retaining member for the trailing end of the first web. The device also includes a pressure applicator to press the trailing end of the first web against the leading end of the second web to cause the webs to be joined, and a cutter to cut the first web to form the trailing end. An element which carries the second retaining member is movable to move the trailing end of the first web away from the support for the first web and each retaining member is associated with a bearing surface which the second retaining member is made to approach. The bearing surface is aligned with and disposed before the respective first retaining member with respect to a direction of advance of a web being unwound from a corresponding reel.

8 Claims, 8 Drawing Sheets

DEVICE AND METHOD FOR THE AUTOMATIC EXCHANGE OF REELS OF WEB MATERIAL

DESCRIPTION

TECHNICAL FIELD

The invention relates to a device for the automatic exchange of a first reel, on which a first web fed to a rewinding machine is wound, with a second reel on which a second web is wound, the device comprising at least one pair of supports for the said reels, movable in a direction parallel to the axis of the said reels; a moving element carrying a retaining member for the trailing end of the said first web; and pressing means to press the trailing end of the said first web against the leading end of the said second web.

BACKGROUND ART

In paper converting lines, a web material is unwound from a large-diameter reel and is fed to what is known as a rewinder, in other words a machine which forms, with the web material taken from the reel, a plurality of logs or rolls of smaller diameter and of length equal to the length of the original reel. The logs are subsequently cut into small rolls of smaller length, such as rolls of toilet paper, kitchen paper or similar. In some cases, two thin layers of Web material, taken from two separate reels, are fed to a single rewinder and are joined together during the unwinding of the reels.

When the web material fed from one reel is used up, the reel has to be replaced and the trailing end of the web material taken from the reel becoming used up has to be joined to the leading end of the web material wound on the new reel. Various devices have been designed to perform this operation. For example, U.S. Pat. No. 4,629,531 describes a system in which the end of a waiting full reel is manually prepared on a suction table. When the web fed from the reel in use is becoming used up, it is sucked up by two adjacent suction boxes and cut transversely along a line between the said two boxes, and the trailing edge formed in this way is glued to the leading edge of the web material prepared on the suction table, which for this purpose is made to oscillate towards the suction boxes located above it. This device is extremely complex and labour-intensive. Moreover, it cannot be easily used in tissue paper converting lines, because of the particular disposition that it has to assume with respect to the path of the paper.

For the automation of the operation of exchanging the reel and joining the trailing edge of a web becoming used up to the leading edge of a web wound on a new reel, IT-B-1213819 describes a device with an oscillating arm carrying a suction box which, when the web material wound on a reel in use is almost used up, is made to rest on the core of the reel and sucks up the trailing edge of the web material, keeping it connected to the rewinder. The oscillating arm is then moved away from the core of the reel becoming used up, while the trailing edge of the web material remains adhering to the suction box carried by the arm. The used reel is then replaced with a new reel, and the oscillating arm is brought into contact with the outer cylindrical surface of the new reel, so that the trailing edge held by the suction box is made to rest on and is pressed against the outermost turn of the web material wound on the new reel which is suitably angularly positioned. A double-sided adhesive tape, suitably prepared, is used to stick the two layers together.

This device is simple, permits rapid replacement of the reel and a rapid joining of the two webs, and considerably reduces the intervention of the operator. However, it has a limitation due to the fact that the reel in use can be replaced only when it is almost completely used up. In practice, however, there are frequently cases in which the reel in use has to be replaced at an intermediate point, between the start of unwinding and the using up of the reel. This happens because the layer or web wound on the reel may have defects or breakages in any position. In this case, the reel has to be stopped, the web has to be cut, the portion having the defect has to be removed, and then the two edges of the web material have to be rejoined to recommence the process of unwinding and feeding of the web material to the rewinder.

From U.S. Pat. No. 4,392,912 a device is known, for the automatic exchange of a first reel, on which a first web fed to a processing machine is wound, with a second reel on which a second web is wound. This device is particularly designed for reels of very limited axial length, especially for the production of cigarettes. It includes in combination: one pair of supports for said reels, movable in a direction parallel to the axis of the reels; fixed to each of said supports a respective first retaining member for the leading end of said second web, each of said first retaining members being movable with the corresponding support between a lateral waiting position and a position of alignment with a second retaining member for the trailing end of said first web, said second retaining member being carried by a fixed element. Pressing means are also provided, to press the trailing end of the said first web against the leading end of the said second web, causing them to be joined together. A cutting means cuts the said first web to form the said trailing end. Cutting and splicing are obtained by means of a unit which carries said pressing means and said cutting unit and is movable in a direction orthogonal to the web feeding direction. A double actuator is provided: the first actuator moves the unit towards the fixed element which is provided with a suction plate and the second actuator moves the cutting blade into a cutting channel upstream the suction plate.

DISCLOSURE OF THE INVENTION

The object of the present invention is to provide a reel-exchanging device which enables a reel in use to be replaced with another at any point in the operating cycle, and not necessarily when the reel in use is becoming used up.

A further object of the present invention is to provide a device which enables an empty or damaged reel to be replaced with another, thus reducing to a minimum the downtime of the converting line and avoiding the necessity for the operator to access the interior of the equipment.

A further object of the present invention is to provide a joining device which is simpler and more compact than the devices known at present.

These and other objects and advantages, which the following text will make clear to those skilled in the art, are obtained, essentially, with a device of the type mentioned initially, in which the element carrying the retaining member for the trailing edge is movable such as to move the trailing edge of the first web away from the relevant support; and each one of the retaining members which retain the leading edge of the second web is associated with a bearing surface which the trailing edge retaining member is made to approach, said bearing surface being movable integrally with the respective leading edge retaining member and being disposed before said retaining member with respect to the direction of advance of the web being unwound from the corresponding reel.

With this arrangement, when the first reel has to be replaced the moving element supporting the means of retaining the trailing end of the first web is moved to grip, with the retaining member, the free trailing edge which is created by the cut. This operation may be performed at any moment, regardless of the diameter of the reel in use, which may be nearly used up or may be only just started or half used. This enables the feed to be interrupted when damage is found in the web being fed. The new reel is transferred from a waiting position, which is lateral with respect to the line, to the operating position. Before this, the free leading edge of the new reel has been correctly positioned on the retaining member of the leading edge of the second web. This operation may take place outside the converting line and in darkness, in other words without extending the machine downtime.

Advantageously, both the retaining members may be suction members. It is also preferable to dispose the cutting means on the moving element which carries the retaining member designed to grip the trailing end of the first web, although a solution in which the cutting means are carried by an independent member may be considered. The retaining member of the trailing end of the web being unwound may be mounted on a moving device for traversing, for example a sliding unit, or on an oscillating arm, and the same may apply to the cutting means, which may be on the same oscillating arm or on the same sliding unit as the retaining member, or on an independent oscillating arm or sliding unit.

In the preferred embodiment of the device according to the invention, the retaining member of the leading end of the second web is carried by a carriage which is movable transversely with respect to the direction of feed of the web from the said reels, the said carriage carrying two supports for two reels, either of which may be positioned in the operating position. However, the two supports may be disposed on two carriages aligned with each other and connected or operated in a combined way.

Further advantageous features of the device according to the invention are indicated in the attached claims and will be described in greater detail in the following text.

BRIEF DESCRIPTION OF THE DRAWINGS

The invention will be more clearly understood from the description and the attached drawing which shows possible non-restrictive practical embodiments of the invention. In the drawing.

DETAILED DESCRIPTION OF PREFERRED EMBODIMENTS

In the following text the joining device will be described in combination with a paper converting line, in which the application of this device is particularly advantageous. However, the same device may also be used in different converting lines, possibly with different types of material, but which present similar problems in respect of the joining of two successive webs to be fed.

Figure 3:
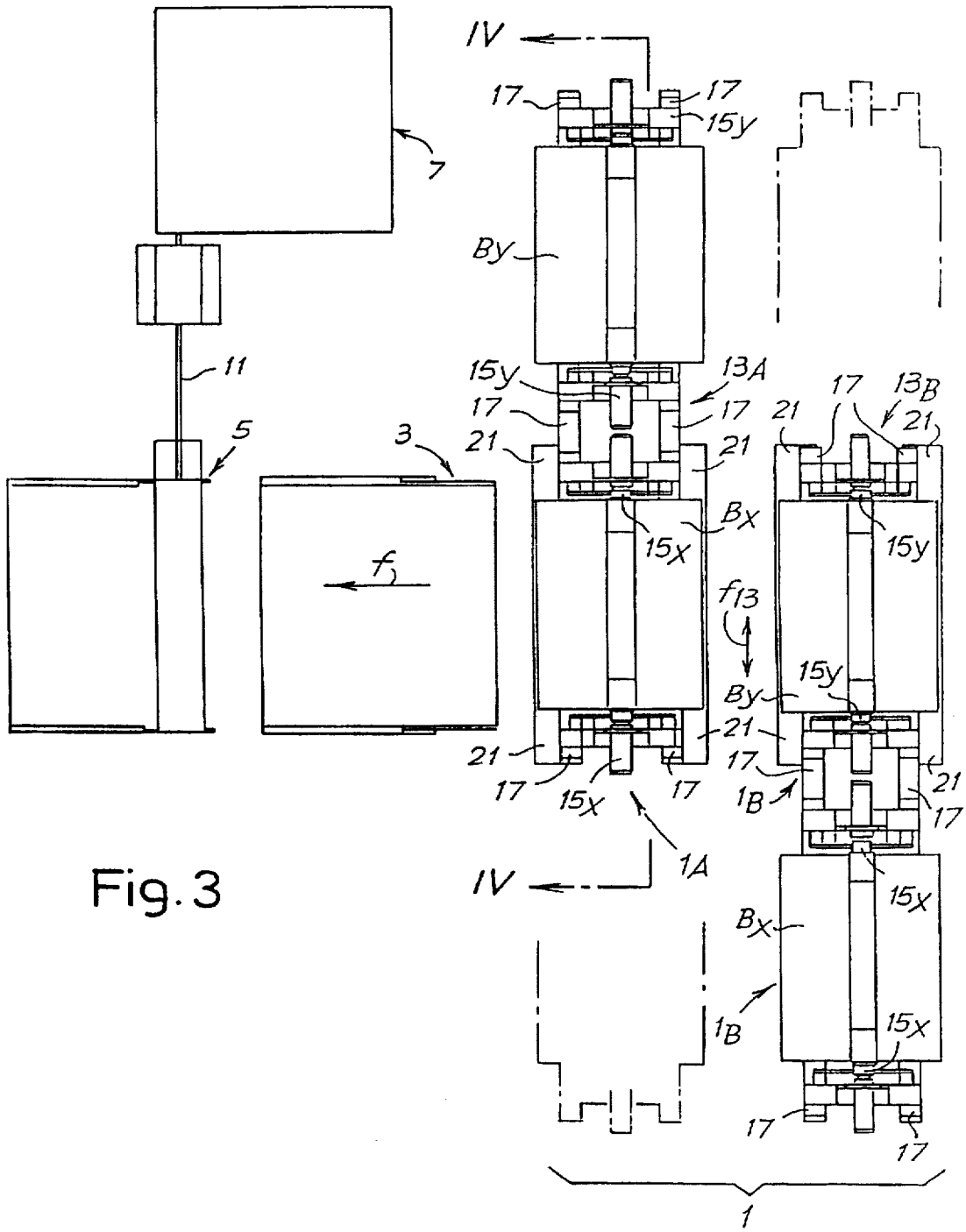
FIG. 3 is a schematic plan view of the converting line to which the section shown in FIG. 1 belongs.

FIG. 3 shows a possible configuration of a paper converting line, typical of installations producing what is known as tissue paper. The number 1 indicates in a general way the section in which the initial reel or reels from the paper factory are unwound. In the example in FIG. 3, two unwinding stations 1A and 1B are provided for the simultaneous unwinding of two reels, each of which consists of a layer, preferably single, of web material, although it is possible for each station to unwind a reel formed from two or more previously joined layers. The layers unwound from the stations 1A and 1B are fed in the direction of the arrow f to an embossing (and possibly a printing) unit indicated in a general way by 3, and from this to a rewinder indicated in a general way by 5. The rewinder 5 rewinds the web material, consisting of two or more layers, on a cardboard core from a hopper container 7 disposed at one side, from which the individual cores are taken by a conveyor system 11 and glued, for example along the path of insertion into the rewinder. The embossing unit 3 and the rewinder 5 may be of any type and are known in themselves. In particular, the rewinder 5 may be a rewinder of the central type or a surface rewinder, and possibly of the type operating without a central winding core, the operating principle of the rewinder having no effect on the device which is the subject of the present invention. The rewinder could also be of the type used for the simultaneous production of a number of rolls whose length is smaller than the length of the initial reel. These rewinders are frequently used for the production of industrial rolls whose diameters are greater than those of conventional logs.

Figure 4:
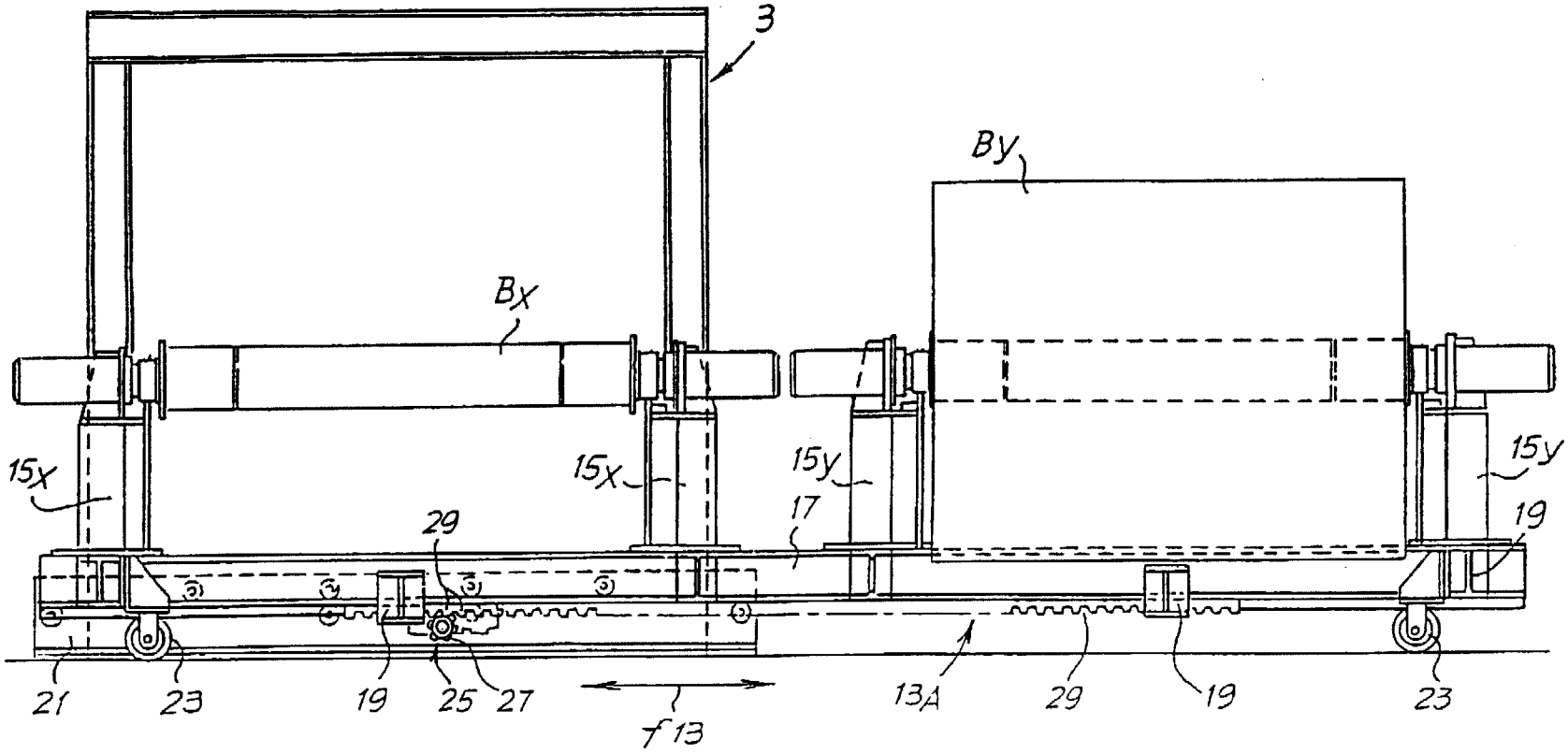
FIG. 4 is a transverse section through IV—IV in FIG. 3.

Two carriages 13A and 13B, only one of which will be described in the following text, the other being substantially identical, are disposed in the section 1. Each carriage 13A, 13B has a pair of supports 15X, 15Y for corresponding reels BX, BY of wound web. The cross-section in FIG. 4 shows the carriage 13A with an empty reel BX on the support 15X and a new reel BY on the support 15Y.

Each carriage 13A, 13B is formed by a pair of longitudinal members 17 connected together by cross-pieces 19. The longitudinal members 17 are guided in corresponding roller guides 21 (two for each carriage 13A, 13B) which are fixed to the ground. The guides 21 extend transversely over approximately the width of the line only, so that they do not form obstructions at the sides of the line. The carriage is supported not only by the roller guides 21 but also by two pairs of wheels 23 disposed near the ends of each carriage. As is clearly seen in FIG. 4, the wheels 23 disposed at the end of the carriage not guided by the guides 21 rest on the ground and transmit part of the weight of the carriage, while the other pair of wheels is substantially free of loading, since the weight of the corresponding section of the carriage is transmitted to the guides 21.

The number 25 schematically indicates a drive unit which, by means of a pinion 27 engaging with a rack 29 integral with the corresponding carriage 13, moves the carriage transversely in the direction of f13.

In the configuration shown in FIG. 3, the two webs unwound from the reels BX of the carriage 13A and BY of the carriage 13B are fed to the embossing unit 3 and the rewinder 5, the corresponding supports of the reels being aligned with the converting line 1, 3, 5. Two reels BY and BX are placed on the supports 15Y of the carriage 13A and 15X of the carriage 13B respectively, waiting to replace the used reels. The replacement is carried out by the traversing of one and/or the other carriage in the direction of f13. The replacement is not necessarily carried out simultaneously for the two carriages 13A, 13B, but at different times in most cases. By using transversely movable carriages the reel on the carriage may be placed in the lateral position outside the converting line, while the web material unwound from the reel in the operating position is fed from the same carriage.

Figure 1:
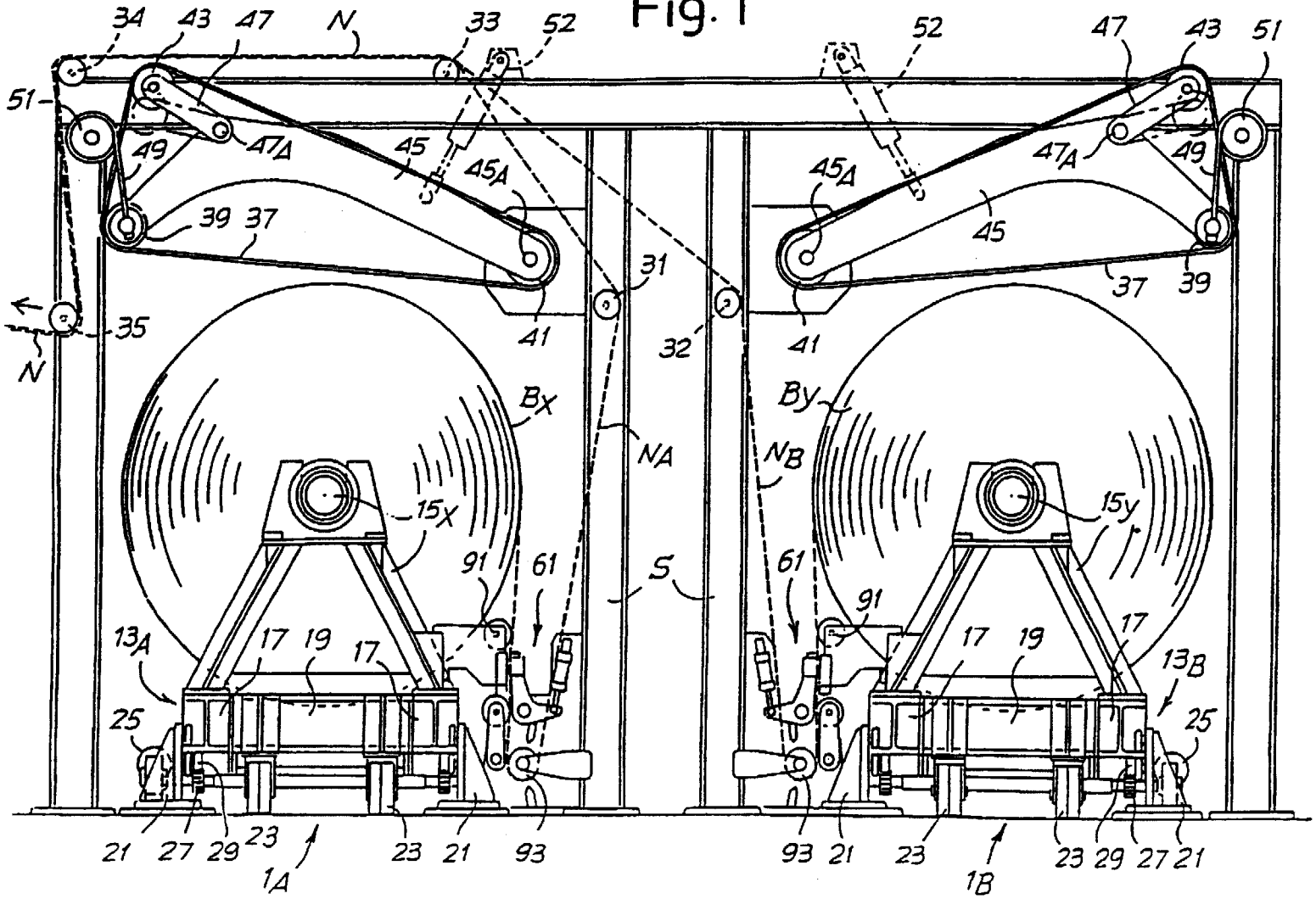
FIG. 1 is a side view of the reel unwinding section in a paper converting line, with two reels in use simultaneously.

As may be seen in FIG. 1 in particular, the two webs NA and NB from the two stations 1A and 1B are run around guide rollers 31, 32, 33, 34, 35 and joined to form a single web N fed to the units 3 and 5.

Figure 2:
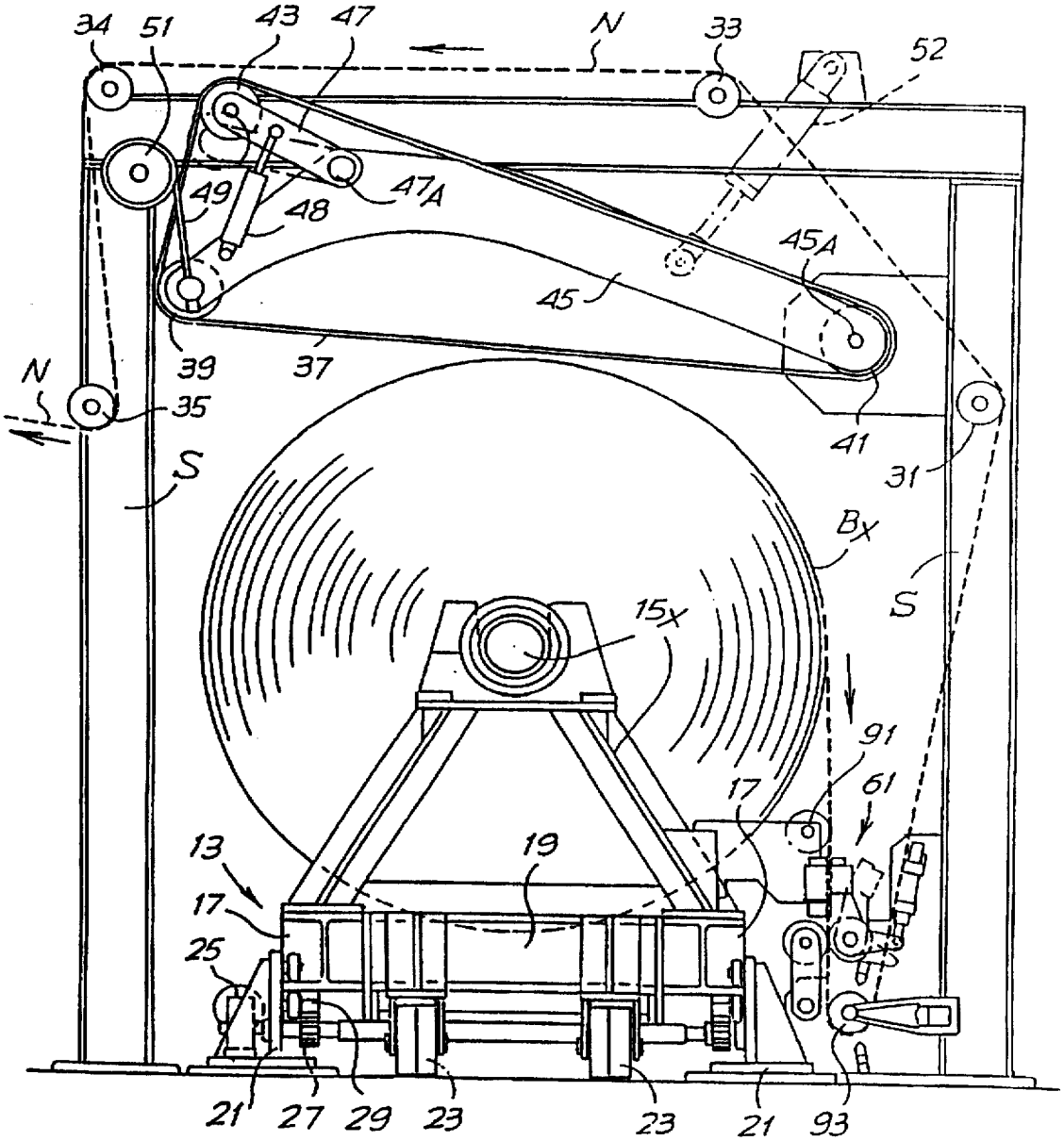
FIG. 2 is a side view of a section similar to FIG. 1, but with only one reel in use.

FIG. 2 shows the case in which the web N is unwound from a single reel. The number of reels simultaneously in use and the number of layers forming the web N fed to the rewinder 5 may vary according to the type of product being manufactured and are irrelevant for the purposes of the present invention.

Each reel is unwound by means of a belt or a set of parallel belts 37. Each belt 37 is run around a system of three pulleys 39, 41, 43, at least one of which (typically the pulley 41) is powered. The pulleys 39 and 41 are carried by a corresponding oscillating arm 45, hinged about an axis 45A to the fixed structure S of the machine. Conversely, the pulley 43 is carried by an auxiliary arm 47, hinged at 47A to the arm 45. Between the arm 45 and the auxiliary arm 47 there is interposed an elastic system 48 (shown for simplicity in FIG. 2 only) such as a pneumatic cylinder and piston system, which is used to keep the belt 37 in tension.

The arm 45, with the corresponding members carried by it, is suspended by means of a cable 49 of a hoist schematically indicated by 51. The angular position of the arm 45 is adjusted by means of the hoist 51 which unwinds or rewinds the cable 49.

To unwind the reel, the arm 45 is lowered from the position shown in FIGS. 1 and 2 until the belt 37 is brought into contact with the outer surface of the reel over a sufficiently large arc, thus providing a frictional force sufficient to cause the rotation of the reel and consequently the unwinding of the web. The tension on the belt 37 is provided by the elastic system 48. When the belt 37 (or belts 37) is made to rotate, the reel is caused to rotate and the feeding of web from the reel causes a gradual reduction of the diameter of the reel, and consequently an elongation of the elastic system 48, with the consequent oscillation of the auxiliary arm 47 which tends to compensate for the slackening of the belt due to the reduction in diameter of the reel.

When the auxiliary arm 47 has reached a predetermined angular position, which may be detected by means of a position transducer of a known type, and possibly also by a transducer of the linear type disposed on the cylinder and piston system 48, the hoist 51 is operated to elongate the cable 49 and consequently to lower the arm 45. This enables the elastic system 48 to be compressed again and enables the maximum tension of the belt 37 to be recovered. The extent of the elongation of the cable 49 is further determined by means of a transducer which detects the angular position of the auxiliary arm 47 or the position of the cylinder and piston system 48. This transducer may be the one which causes the hoist to be started. It is also possible to stop the rotation of the hoist and the elongation of the cable 49 by means of a delay unit which stops the hoist after a specified time, or by means of an encoder which determines the angle of rotation of the hoist and consequently the extent of the elongation of the cable.

The unwinding system described above has the advantage, as compared with conventional systems, of drastically reducing the mass which may begin to vibrate during the unwinding of the reel. In fact, the arm 45 suspended by the cable 49 acts in practice as a rigid body, and does not vibrate. Any vibrations (due for example to the irregularity of the windings of web material wound on the reel and consequently to the imperfect cylindricality of the reel) are limited to the auxiliary arm 47 and the corresponding pulley 43, which are of very low mass. This limits both the dynamic stresses on the machine and the noise.

The same advantages are obtained by replacing the cable and hoist system 49, 51 with a hydraulic cylinder and piston actuator as shown in broken lines and indicated by the number 52 in FIGS. 1 and 2. The hydraulic actuator imparts the same rigidity to the arm 45.

Each carriage 13A, 13B is associated with a device, indicated in a general way by 61, which is used to join the trailing end of one web to the leading end of a new web from a new replacement reel.

Figure 5:
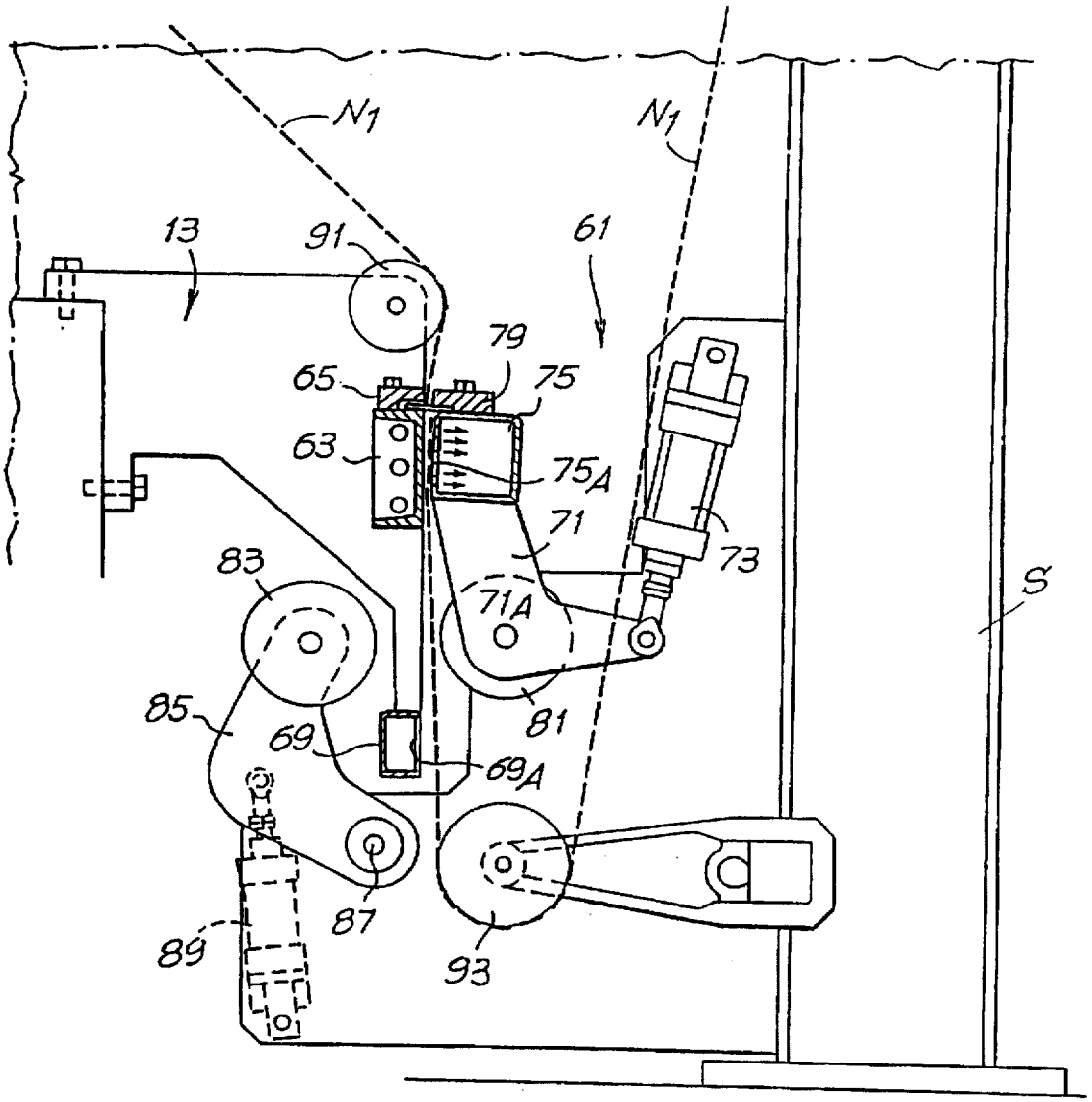
FIGS. 5 to 7 show the web-joining device in three successive stages of the joining operation.
Figure 6:
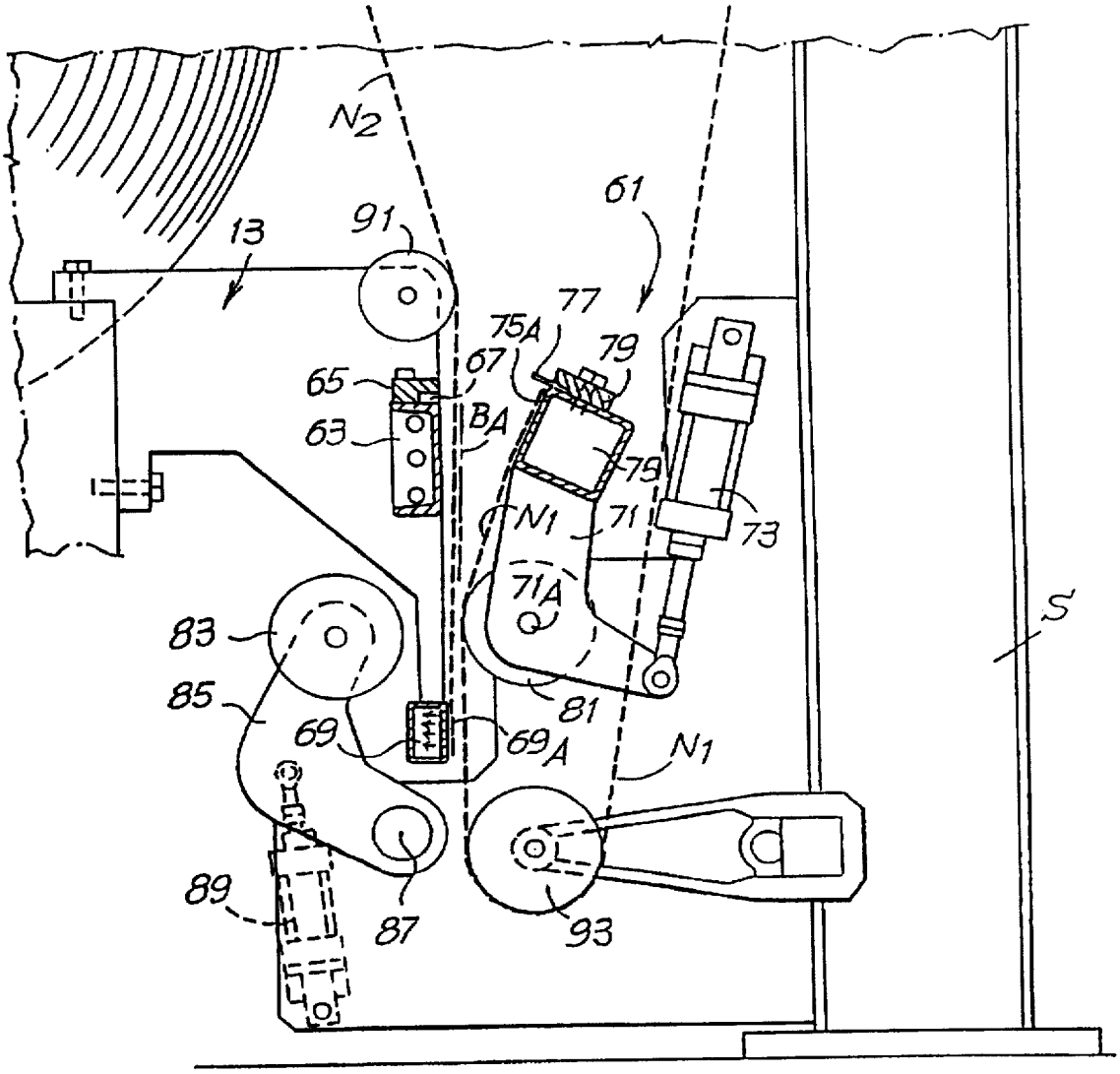
Figure 7:
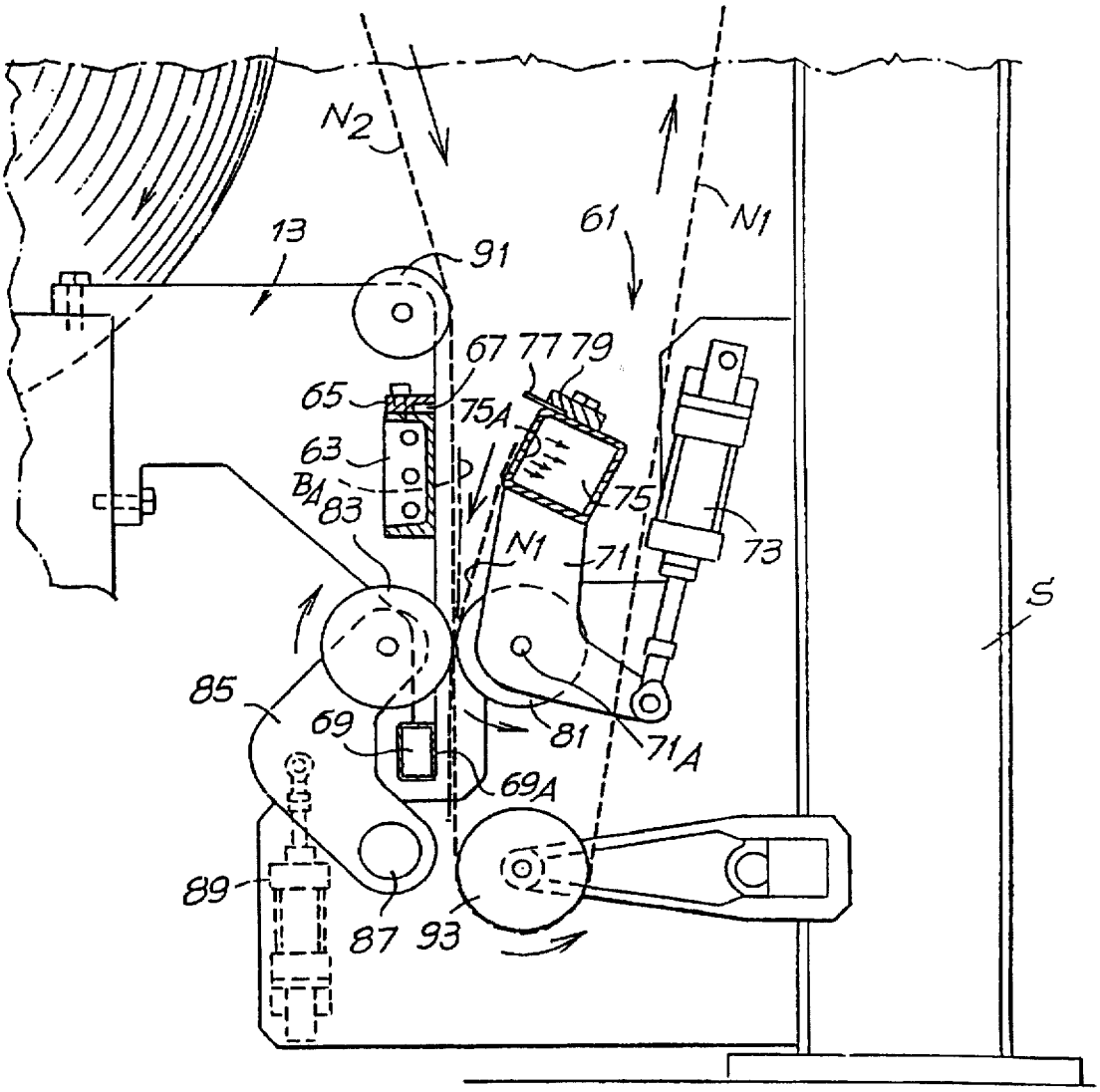

The device, indicated purely schematically in FIGS. 1 and 2, is illustrated in detail in FIGS. 5 to 7 in its different positions. The device 61 has some members carried on the corresponding carriage 13A or 13B, and some members carried on the fixed frame of the machine.

On the carriage 13 there is disposed a cross-piece 63, on which is mounted a section 65 defining a cutting channel or counter-blade 67, extending in the direction f13 of movement of the carriage for a distance at least equal to the transverse dimension of the web to be cut. Since the carriage 13 carries two aligned reels of which one is in use and the other is waiting, the members 63, 65, 67 and 69 may extend over the whole length of the carriage, in other words for more than twice the axial dimension of the reel. Conversely, two aligned sets of members 63, 65, 67 and 69 may be provided, one for each support, for the corresponding reels.

Under the cross-piece 63, and at a certain distance from it, there is disposed a first retaining suction member 69, with a permeable suction wall 69A facing in the same direction as the opening of cutting channel 67.

A pair of parallel oscillating arms 71, hinged about an axis 71A, and operated by an actuator 73 of the cylinder and piston or equivalent type, is fixed to the structure S of the machine. The arms 71 carry a second retaining suction member 75, made in the form of a box-section cross-piece, with a permeable suction wall 75A. The box-shaped Cross-piece forming the second suction member 75 is associated with a blade 77 fixed by means of a block 79 and interacting with the channel or counter-blade 67.

The second retaining suction member 75 and the corresponding blade 77 may be carried by a sliding unit movable along traversing guides, rather than by oscillating arms 71.

The blade 77 may be a continuous or serrated blade, and may have strips of compressible material, which press the web material against the sides of the channel 67 during the cut, fitted along its sides. The compressible material forming the strips along the sides of the blade may also be made to extend to cover the blade 77 partially or completely.

The device also comprises a pair of pressure rollers 81, 83, the first of which has a fixed axle coinciding with the axis 71A of the oscillating arm 71. The second pressure roller 83 is carried by a pair of brackets 85 hinged at 87 to the structure of the machine and caused to oscillate by a cylinder and piston or equivalent actuator 89.

The operation of the device 61 is as follows. During the normal operation of the line, the web N1 is unwound from the reel and guided by a roller 91 carried by the corresponding carriage 13 and by a roller 93 carried by the structure S. The web N1 is fed along a path between the members 63, 65, 69, 83 and the members 71, 73, 75, 77, 81 of the device 61.

In this condition, the pressure rollers 81, 83 are in their position of maximum separation and the blade 77 is disengaged from the channel 67 (FIG. 6).

When it is necessary to replace a reel from which the web N1 is being fed with a new reel, the converting line is stopped and the pair of arms 71 is made to oscillate anticlockwise by the actuator 73 to make the blade 77 interact with the channel 67. This causes the web N1 to be cut in a position intermediate the two guide rollers 91 and 93. The trailing end or tail of the web generated by this cut is retained between the permeable wall 75A of the second suction member 75 and the opposing surface of the cross-piece 63. This configuration of the device 61 is shown in FIG. 5.

When a suction system which maintains a vacuum in the interior of the second suction member 75 is activated, the trailing end of the web N1 adheres to the outer surface of the wall 75A, so that the subsequent clockwise ioscillation of the pair of arms 71 and consequently of the second suction member 75 moves the trailing end of the web N1 away from the carriage 13. The suction is maintained to if retain the trailing end of the web N1 in position until it is joined to the second web.

At this point, the carriage 13 can be traversed in the direction f13, to bring the other support, on which the new reel has been placed, next to the converting line. The leading end of the web N2 wound on the new reel has previously been positioned on the outer surface of the permeable suction wall 69A of the first suction member 69 integral with the carriage 13. A double-sided adhesive BA has also been previously disposed on the web N2, in a position corresponding to the cross-piece 63.

FIG. 6 shows the configuration reached after the traverse of the carriage 13.

The two webs N1 and N2 are joined at this point by making the pressure roller 83 oscillate against the pressure roller 81, and by starting the line again, as shown in FIG. 7. At least one of the two pressure rollers 81, 83 is suitably powered, in such a way that, when the line is restarted, the trailing end of the web N1 and the leading end of the web N2 pass between the pressure rollers 81 and 83 where the pressure exerted by the said rollers causes the mutual adhesion of the two webs by the action of the double-sided adhesive BA applied to the web N2. The two webs N1 and N2 are joined together after the pressure rollers 81, 83.

Figure 8:
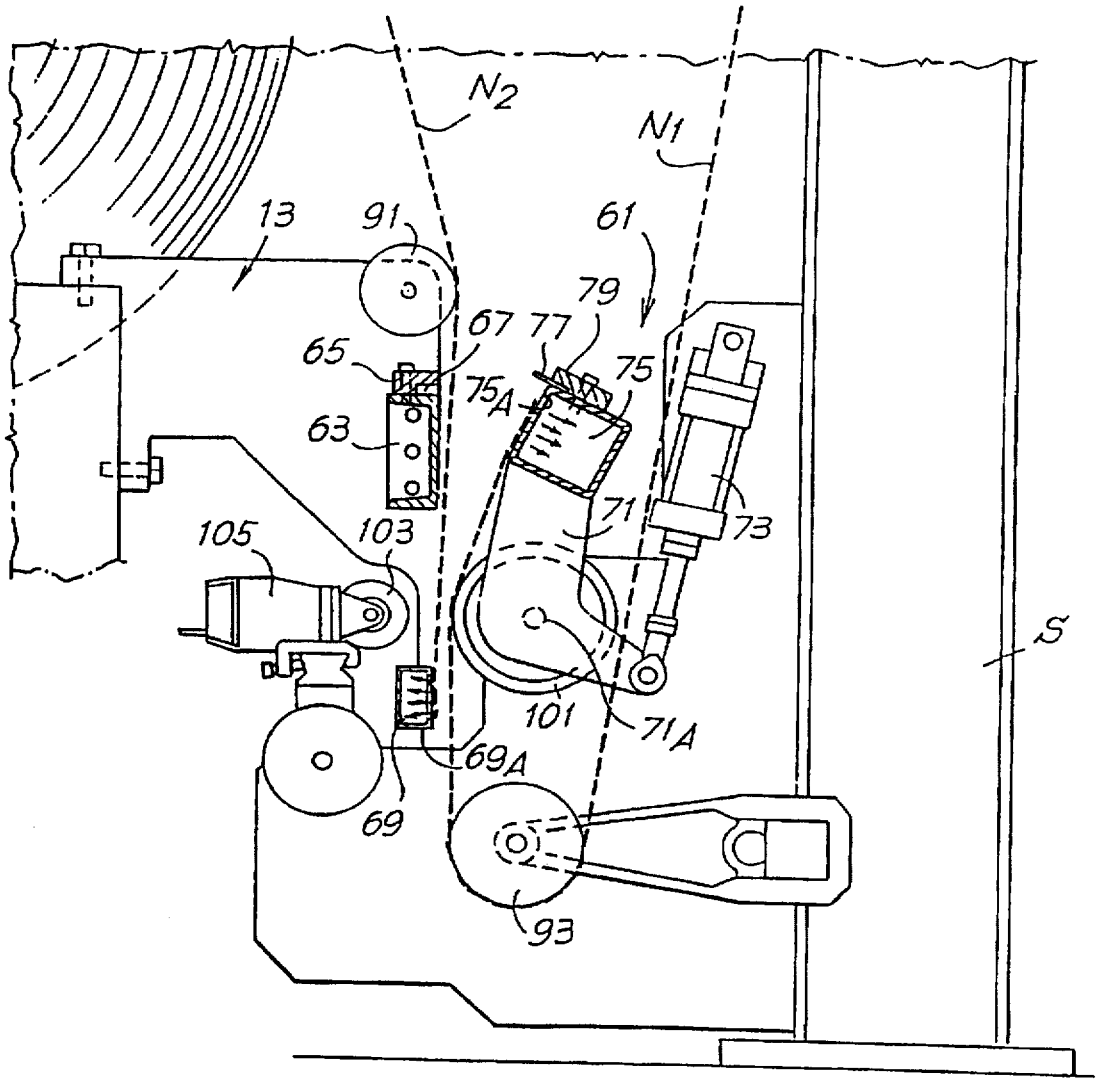
FIG. 8 shows an alternative embodiment of the device shown in FIGS. 5 to 7.

FIG. 8 shows a slightly modified embodiment of the device 61. Parts identical to those shown in FIGS. 5 to 7 are indicated by the same reference numbers.

The device shown in FIG. 8 differs from the device shown in FIGS. 5 to 7 in that the webs are joined by a ply-bonding unit rather than by a pair of pressure rollers and a double-sided adhesive. For this purpose, the two pressure rollers 81, 83 are replaced by a cylinder 101 of steel or other suitable material, interacting with a set of wheels 103 which, at the time of the joining of the webs, are pressed against the cylinder 101 with considerable force. The surfaces of the wheels 103 are knurled or milled in a known way, which, when they are pressed against the cylinder 101, causes the fusion of the layers of paper disposed between the wheels 103 and the cylinder 101. Since the wheels 103 are subjected to stresses different from those on the pressure roller 83, a different supporting and operating system is provided, replacing the brackets 85 and the actuator 89. The operating system for the Wheels, indicated in a general way by 105, may be of a type which is known and is not described here in greater detail.

The disposition of the wheels 103 and of the cylinder 101 may be reversed.

The joining of the webs N1, N2 by ply-bonding has certain advantages over the use of a double-sided adhesive. In the first place, the intermediate operation of application of the double-sided adhesive to the web material is eliminated. In the second place, since the log produced by the rewinder 5, within which the portion of web with the joint is located, has to be rejected, the absence of the double-sided adhesive makes it easier to re-use the rejected log, which can be returned directly into the beater.

The advantages mentioned above are also obtained with a different form of ply-bonding, for example continuous transverse ply-bonding across the web. In this case, the wheels 103 are replaced with a single wheel disposed on a carriage movable transversely over the transverse extent of the web unwound from the reel and interacting with the cylinder 101. The carriage carrying the wheel is driven by an independent motor.

From the operation of the joining device described above it is evident that it may come into operation at any time during the unwinding of the reel, and that its operation is not in any way dependent on the diameter of the reel at that time. This enables the feed of the web material from a reel to be interrupted even when the reel has not been completely unwound, for example in the case of an intermediate defect or breakage of the web material, and enables the processing to continue with a new reel, while the replaced reel is moved outside the line and the operator may work on it to eliminate the defective portion of web material and to prepare the remaining portion of the reel for another replacement.

In the preceding text, reference has always been made to a single carriage carrying two supports for two reels which are brought alternately into the operating position. However, it is possible to use two or more carriages adjacent to each other, each being provided with a single support for one reel only. In this case, each carriage will be provided with a channel 67, a cross-piece 63 and a retaining suction member 69.

It is to be understood that the drawing shows only an example provided solely as a practical demonstration of the invention, and that this invention may be varied in its forms and dispositions without departure from the scope of the guiding concept of the invention. Any presence of reference numbers in the attached claims has the purpose of facilitating the reading of the claims with reference to the description and to the drawing, and does not limit the scope of protection represented by the claims.

I claim:

1. A device for an automatic exchange of a first reel, on which a first web to be fed to a rewinding machine is wound, with a second reel on which a second web is wound, the device comprising:

at least one pair of supports for the first reel and the second reel, movable in a direction parallel to axes of the first reel and the second reel;

fixed to each of said at least one pair of supports a respective first retaining member for a leading end of said second web, each first retaining member being movable with a corresponding support between a lateral waiting position and a position of alignment with a second retaining member for a trailing end of said first web, said second retaining member being carried by an element;

a pressure applicator to press the trailing end of the first web against the leading end of the second web, causing the trailing end and the leading end to be joined together;

a cutter to cut the first web to form the trailing end; wherein said element carrying said second retaining member is movable such as to move the trailing end of the first web away from the support for the first web; and that each first retaining member is associated with a bearing surface which the second retaining member is made to approach, said bearing surface being aligned with the respective first retaining member and being disposed before said first retaining member with respect to a direction of advance of a web being unwound from a corresponding reel.

2. The device as claimed in claim 1, characterized in that the at least one pair of supports are disposed on a carriage movable parallel to axes of the first reel and the second reel.

3. The device as claimed in claim 1 or 2, characterized in that the cutter is carried by the element carrying the second retaining member.

4. The device as claimed in claim 1, characterized in that the second retaining member and the first retaining member are suction members.

5. The device as claimed in claim 1, characterized in that said bearing surface is associated with a counter-blade or channel into which the cutter penetrates.

6. The device as claimed in claim 1, characterized in that said pressure applicator is arranged downstream of said element carrying said second retaining member with respect to web feeding motion.

7. The device as claimed in claim 1, characterized in that said pressure applicator comprises two pressure rollers which press the first web and the second web against each other with a double-sided adhesive disposed in an area in which the trailing end of the first web overlaps the leading end of the second web.

8. The device as claimed in claim 1, characterized in that the pressure applicator includes a ply-bonding system which joins the first web and the second web in the absence of an adhesive.

* * * * *